US010773869B2

(12) United States Patent
Logel et al.

(10) Patent No.: US 10,773,869 B2
(45) Date of Patent: Sep. 15, 2020

(54) CAP FOR A CONTAINER

(71) Applicant: CLARIANT PRODUCTION (FRANCE) SAS, Choisy le Roi (FR)

(72) Inventors: Valere Logel, Levallois Perret (FR); Jacquy Lebon, Challands (FR); Caroline Pot, Montgeron (FR)

(73) Assignee: CLARIANT PRODUCTION (FRANCE) S.A.S., Choisy le Roi (FR)

( * ) Notice: Subject to any disclaimer, the term of this patent is extended or adjusted under 35 U.S.C. 154(b) by 14 days.

(21) Appl. No.: 14/787,371

(22) PCT Filed: Apr. 29, 2013

(86) PCT No.: PCT/IB2013/001171
§ 371 (c)(1),
(2) Date: Oct. 27, 2015

(87) PCT Pub. No.: WO2014/177900
PCT Pub. Date: Nov. 6, 2014

(65) Prior Publication Data

US 2016/0101914 A1 Apr. 14, 2016

(51) Int. Cl.
*B65D 53/02* (2006.01)
*B65D 47/08* (2006.01)
*B65D 51/24* (2006.01)

(52) U.S. Cl.
CPC ..... *B65D 53/02* (2013.01); *B65D 47/0838* (2013.01); *B65D 51/24* (2013.01);
(Continued)

(58) Field of Classification Search
CPC ..... B65D 53/02; B65D 47/0838; B65D 51/24
(Continued)

(56) References Cited

U.S. PATENT DOCUMENTS 3,186,573 A * 6/1965 Salminen ..... B65D 41/185 215/270
3,254,784 A 6/1966 Lancesseur
(Continued)

FOREIGN PATENT DOCUMENTS

CN 2494332 Y 6/2002
CN 1163220 C 8/2004
(Continued)

OTHER PUBLICATIONS

English translation of Chinese Examination Report dated Jan. 25, 2017 with respect to CN Application No. 201380076106.3 (parallel CN Application with regard to international application No. PCT/IB2013/001171).
(Continued)

*Primary Examiner* — Jeffrey R Allen
(74) *Attorney, Agent, or Firm* — Scott R. Cox

(57) ABSTRACT

Disclosed is a cap for a container and a container comprising such cap. This container typically accommodates loosely stored, solid products, such as strips, pills, tablets or the like. The cap includes a lid body with a top part and a peripheral wall, wherein the lid body includes a sealing skirt and an inner peripheral wall, which extend from the top part, and form a peripheral groove in between. At least one projection portion for partially covering the peripheral groove is integrally formed with the sealing skirt and the inner peripheral wall.

22 Claims, 11 Drawing Sheets

(52) U.S. Cl.
CPC ..... *B65D 51/244* (2013.01); *B65D 2401/20* (2020.05); *B65D 2401/50* (2020.05)

(58) Field of Classification Search
USPC ..... 215/320, 227; 206/222, 204, 320; 220/521
See application file for complete search history.

(56) References Cited

U.S. PATENT DOCUMENTS

| | | | | |
|---|---|---|---|---|
| 3,863,798 | A | 2/1975 | Kurihara et al. | |
| 4,386,696 | A | 6/1983 | Goncalves | |
| 4,442,947 | A * | 4/1984 | Banich, Sr. | B65D 41/0421 215/344 |
| 4,498,608 | A * | 2/1985 | Mercil | B65D 51/30 222/190 |
| 4,834,234 | A * | 5/1989 | Sacherer | B65D 39/0023 206/204 |
| 4,899,897 | A * | 2/1990 | Buttiker | B65D 41/485 215/228 |
| 8,365,932 | B2 * | 2/2013 | Lancesseur | B65D 41/485 215/235 |
| 2004/0036229 | A1 | 2/2004 | Takahashi et al. | |
| 2007/0084735 | A1 * | 4/2007 | Lancesseur | B65D 43/164 206/204 |
| 2007/0272646 | A1 | 11/2007 | Lancesseur et al. | |
| 2009/0308834 | A1 | 12/2009 | Isogai et al. | |

FOREIGN PATENT DOCUMENTS

| | | | |
|---|---|---|---|
| CN | 202704169 | U | 1/2013 |
| DE | 19815413 | A1 | 10/1999 |
| EP | 0763477A1 | A1 | 3/1997 |
| WO | W02007057133 | A1 | 5/2007 |

OTHER PUBLICATIONS

International Search Report and Written Opinion dated Nov. 29, 2013 with respect to international application No. PCT/IB2013/001171.

English translation of Chinese Examination Report dated Jun. 17, 2016 with respect to CN Application No. 2013 800 76106 (parallel CN Application with regard to international application No. PCT11B2013/001171).

* cited by examiner

CAP FOR A CONTAINER

TECHNICAL FIELD

The present invention refers to a cap for a container, and a container comprising such a cap. Such preferably substantially tubular or cylindrical containers typically accommodate loosely stored, solid products, such as strips, pills, tablets or the like. The cap is attached to the container for closing the opening thereof so that the products contained therein are protected during storage.

STATE OF THE ART

Caps for containers in the above-mentioned field are typically manufactured separately from the container. The caps are then connected to the container once the container is filled with products to be contained therein.

A tamper-evident closure for tablet tubes is, for example, known from WO 2007/057133 A1. The closure/cap comprises a ring connected to the container and a lid, which again is connected to the ring by means of a hinge and tear-off/tamper-evident webs between the ring and the lid.

Caps of this type generally have a sealing skirt for fitting the cap to the inner wall of the container in an air-tight manner, and a desiccant chamber containing a moisture and/or oxygen trapper. In such configurations, a peripheral groove is formed between the sealing skirt and an inner peripheral wall of the desiccant chamber.

As products accommodated in the container may be of small size or flat-shaped, there is a risk that the products enter or get stuck in the peripheral groove between the sealing skirt and the inner peripheral wall. However, to avoid this problem, the peripheral groove cannot be filled for providing a connection between the sealing skirt and the inner peripheral wall, because the sealing skirt would in this case lose its flexibility required for providing an air-tight connection to the tubular container.

To resolve this problem, some prior art caps use a cardboard, which has a larger diameter than the desiccant chamber, but a smaller diameter than the sealing skirt. Such a cardboard is connected to the lower end of the desiccant chamber by a crimping connection. In that manner, the cardboard covers the peripheral groove.

However, these caps have several disadvantages. Firstly, the height of the desiccant chamber must be smaller than the height of the sealing skirt and cannot be adjusted or increased according to the volume of the required desiccant. Secondly, when fitted in an inner wall of the container, the deformation of the sealing skirt providing the airtightness can lead to a deformation of the cardboard, which again may move, fold, corrugate or loosen from the inner peripheral wall. In this case, the desiccant leaks from the desiccant chamber. Furthermore, the sealing portion of the sealing skirt providing the airtightness should be sufficiently distant from the lower end (distal end) of the sealing skirt. Otherwise, the sealing portion would be degraded during the crimping process.

SUMMARY OF THE INVENTION

It is an object of the present invention to provide a cap for a container which avoids the above mentioned problems, thereby providing a cap with improved storage performance.

This object is achieved by a cap for a container comprising the features of independent claim 1. Further preferred embodiments are outlined in the dependent claims.

The underlying idea of the present invention is to provide a projection portion for at least partially covering the peripheral groove formed between the sealing skirt and the inner peripheral wall of a lid body. The projection portion, which is integrally formed with the sealing skirt or the inner peripheral wall, may either extend from the sealing skirt to the inner peripheral wall, or vice versa.

"Integrally formed" includes, according to the present invention, integrally molding the corresponding elements. For example, the at least one projection portion is formed together with the sealing skirt or the inner peripheral wall in an injection molding process.

Alternatively, "integrally formed" refers to a connection, which may only be removed in a destructive manner. This case applies to, for example, welding or connecting the elements by a heat treatment. In particular, if the elements to be connected together are formed of a polymer, the connecting portions of one or both elements may be heated to a particular temperature, and the elements may be pressed against each other. According to yet another example, the elements may be connected to each other by an adhesive.

According to yet a further alternative for a fixed connection, the corresponding elements may be connected by snapping, sticking or the like.

In any case, it is preferred that the sealing skirt, the inner peripheral wall and the at least one projection portion are formed of the same material, in particular a polymer. Examples of preferred polymers are PEHD, PEED or PP which show greater flexibility properties.

By providing at least one projection portion for partially covering the peripheral groove formed between the sealing skirt and the inner peripheral wall, the products accommodated in the container cannot enter the peripheral groove. Thereby, the storage performance of the container is improved without degrading the functions of the cap or increasing the manufacturing costs.

Preferably, a distal portion of the inner peripheral wall extends further from the top part as compared to a distal portion of the sealing skirt.

In a preferred embodiment, the at least one projection portion is arranged on a distal end portion of the sealing skirt, which distal end portion is arranged opposite to the top part of the lid body. The peripheral groove is, thereby, effectively covered, and the cap can be easily removed from a mold. In this embodiment, the cap can be removed in one step, for example by ejecting the cap out of a mold.

In a further embodiment, which may also be implemented in combination with the above identified embodiment, the at least one projection portion is arranged on a side surface of the sealing skirt.

In this embodiment, removing of the cap from a mold could be performed by two steps:

- removing a pin/first part of the mold that is opposed to the projection portion (for releasing higher flexibility), and then,
- removing the cap from a second pin/part of the mold (the projection portion being released easier due to a greater freedom of movement of the wall/skirt).

Further, the at least one projection portion may be inclined with respect to the sealing skirt and/or inner peripheral wall, in particular by 30-60 degrees, most preferably around 45 degrees. By providing an inclination angle, the cap can be easily release from a mold.

According to another configuration, an interstice may be provided between the at least one projection portion and the sealing skirt or the inner peripheral wall, respectively, wherein the interstice is preferably 0.5 mm or more. Accordingly, the flexibility of the sealing skirt is maintained so that the sealing skirt can snugly fit to the inner peripheral wall of a container, thereby providing an air-tight connection. Further, no additional force is required for opening the lid body.

According to a preferred embodiment of the present invention, the cap further comprises a ring-element configured to be connected to a container, the lid body being connected to the ring-element. The ring-member may provide a secure connection of the lid body to the container even in an opened position thereof (for example by a hinge), and may in a specific configuration comprise a temper-evidence means. The hinge may in addition be curved so as to maximize the degree of opening of the lid body.

According to a preferred embodiment, the ring-element is a tamper-evident ring comprising frangible webs, which are connected to the lid body. The frangible webs will be broken upon opening the lid body, and the first opening is thereby evidently indicated to the consumer.

It is preferred that the cap is manufactured in one piece by injection molding, in particular from polymer material. This approach has a positive effect on the manufacturing costs for each cap. Further, even if the at least one projection portion is also integrally molded with the cap, the cap can be easily removed from the mold due to the flexibility of the projection portion.

According to a preferred embodiment, at least two projection portions are provided, in particular 8-14 projection portions. The width of the projection portions is preferably around 1-5 mm, and the projection portions are in particular located equidistant to each other in a circumferential direction. Thereby, products accommodated in the container are prohibited from entering the peripheral groove while the storage performance is maintained.

Preferably, the inner peripheral wall is provided with a permeable surface so as to form a chamber, wherein the permeable surface is in particular a permeable polymer, a cardboard and/or a paper sheet, thereby increasing the functionality of the cap. The chamber may contain an active agent, in particular active carbon, silica gel, molecular sieve, clay, other zeolites or mixtures thereof. Further examples refer to iron-based oxygen scavengers, organic oxygen scavengers, enzymatic scavengers or unsaturated polymers, or a mixture thereof.

The permeable membrane is preferably connected to the lid body by bending the distal portion of the inner peripheral wall to the inner portion, i.e. towards the axis of the lid body.

According to yet another embodiment, the projection portion tapers towards its distal end. Accordingly, the projection portion may according to this configuration be wedge-shaped. The distal end of the projection portion faces to the opposite wall, i.e. either the sealing skirt or the inner peripheral wall. The projection portion, therefore, exhibits a particular degree of flexibility.

DETAILED DESCRIPTION OF THE PREFERRED EMBODIMENT

Figure 1:
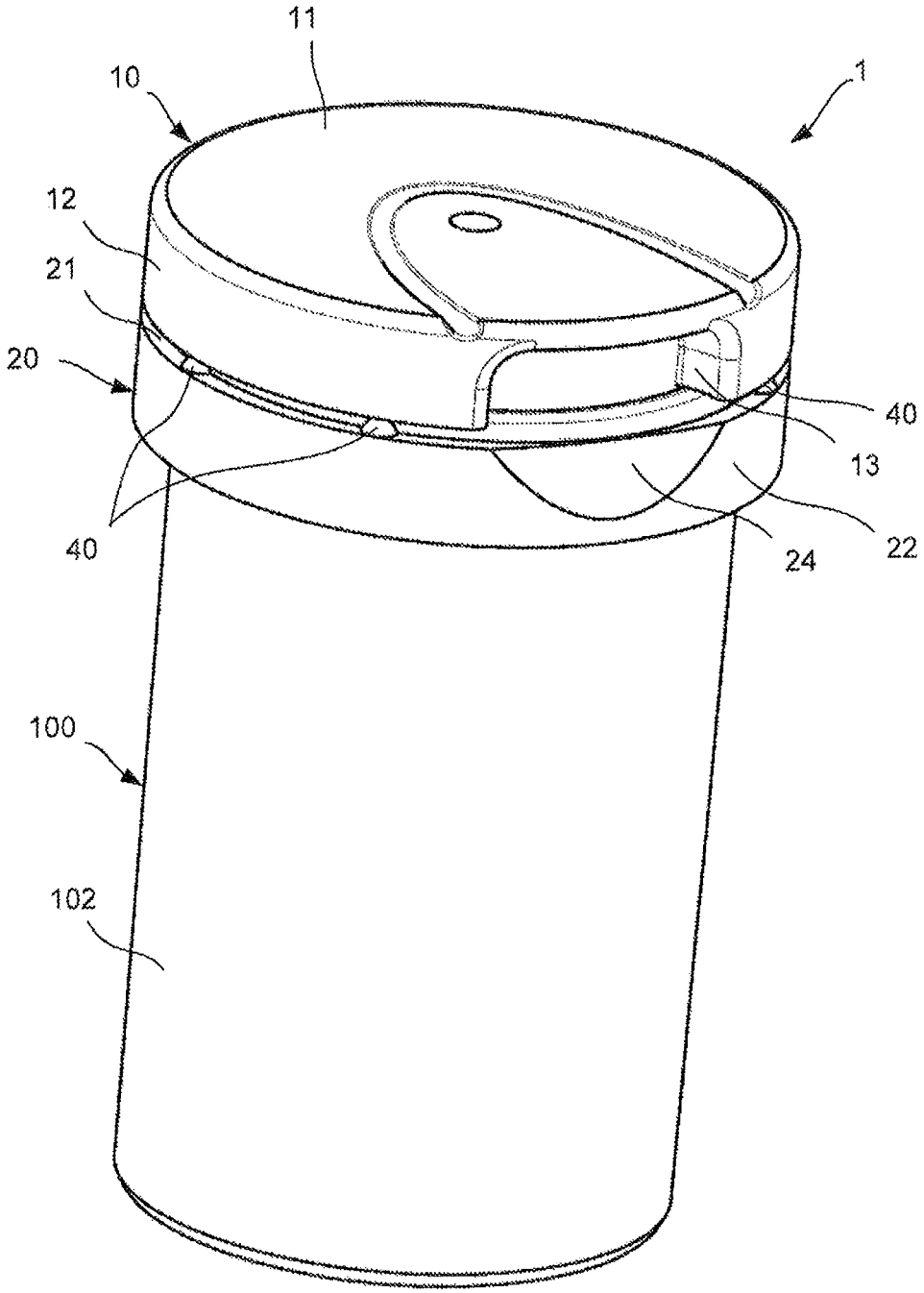
FIG. 1 shows a cap according a preferred embodiment of the present invention attached to a container.
Figure 2:
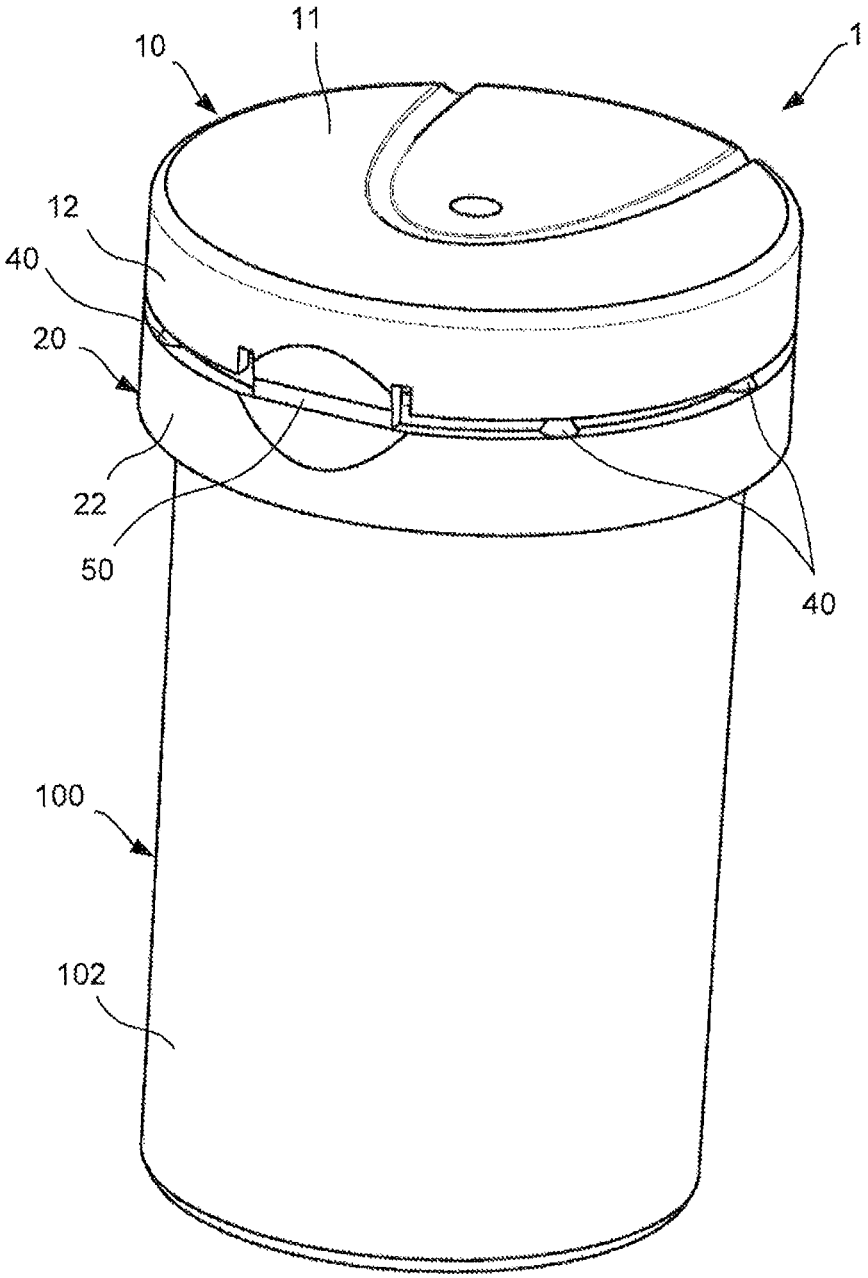
FIG. 2 illustrates the cap according to FIG. 1 attached to the container from a different perspective.
Figure 3:
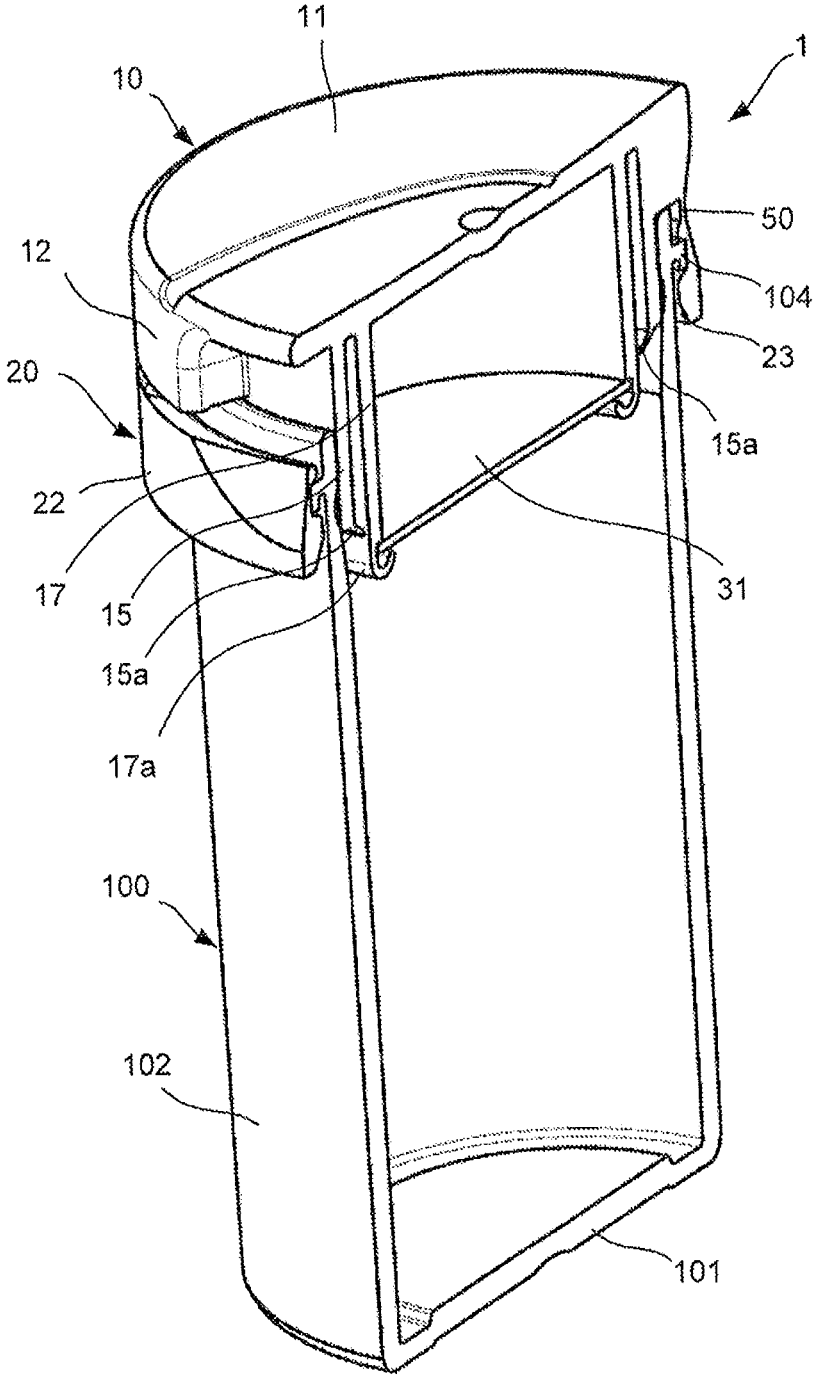
FIG. 3 is a sectional view of the cap and the container according to the preferred embodiment of the present invention.
Figure 4:
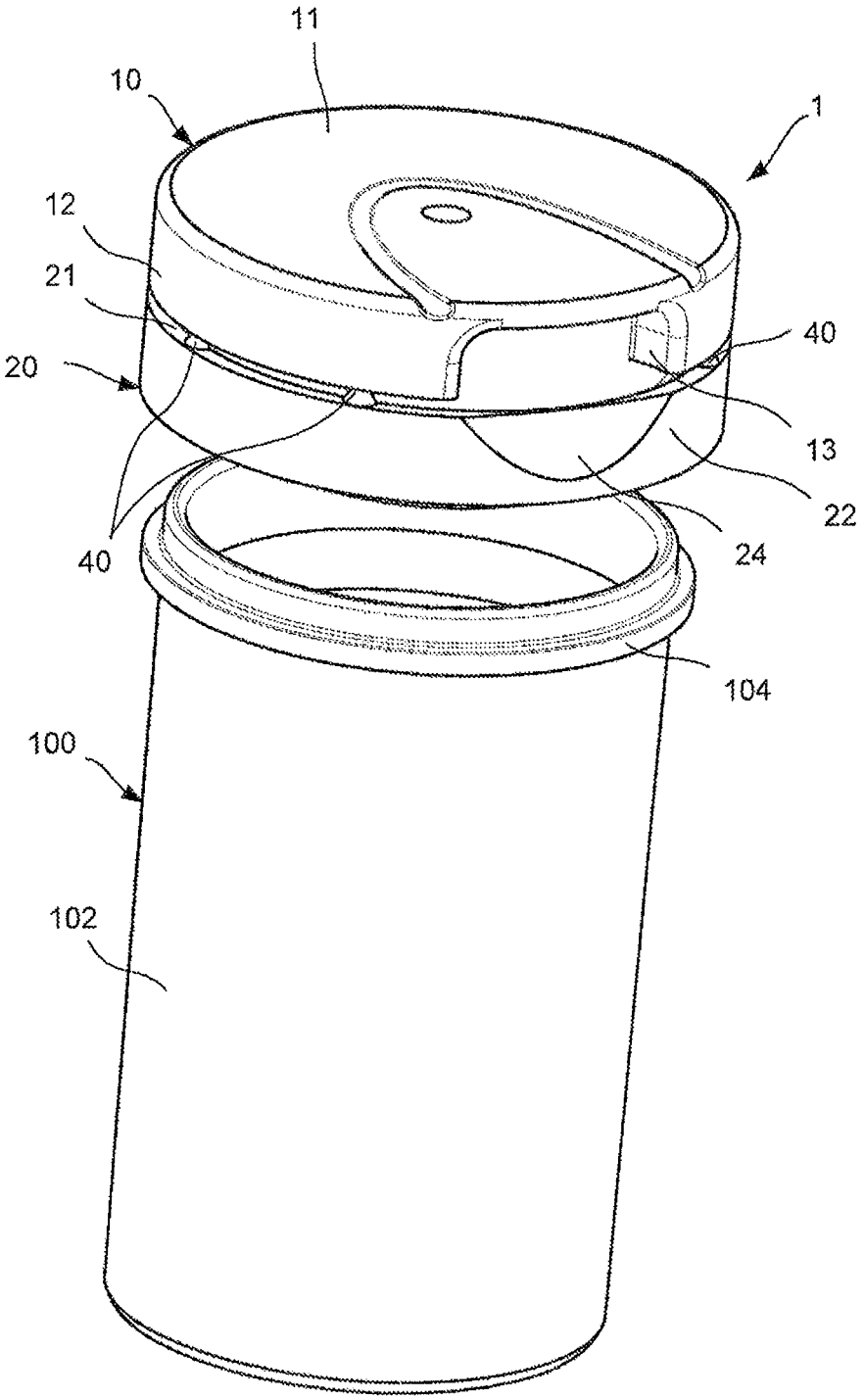
FIG. 4 illustrates the cap according to the preferred embodiment of the present invention before being attached to the container.
Figure 5:
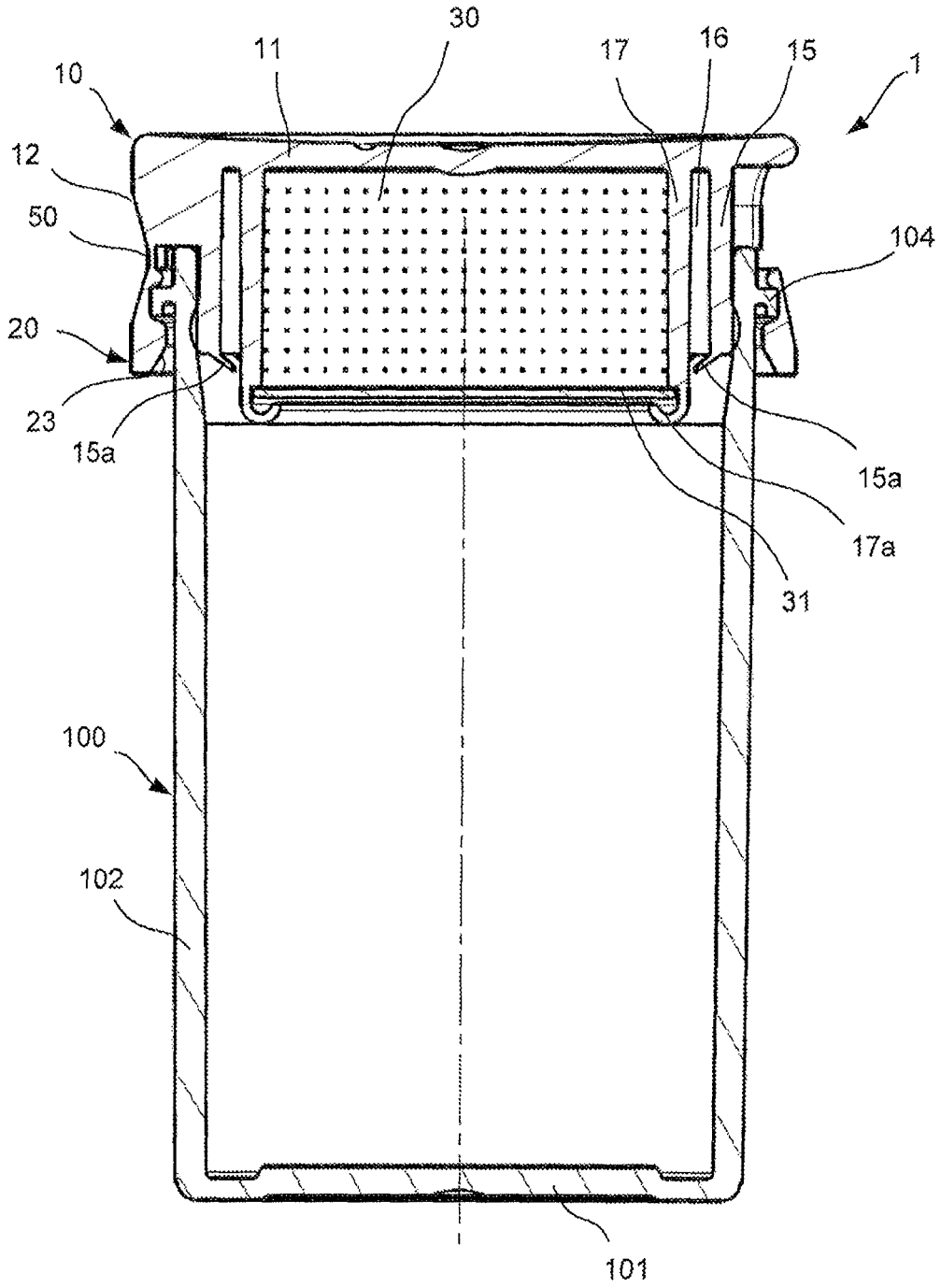
FIG. 5 is a sectional view of the cap being attached to the container.
Figure 6:
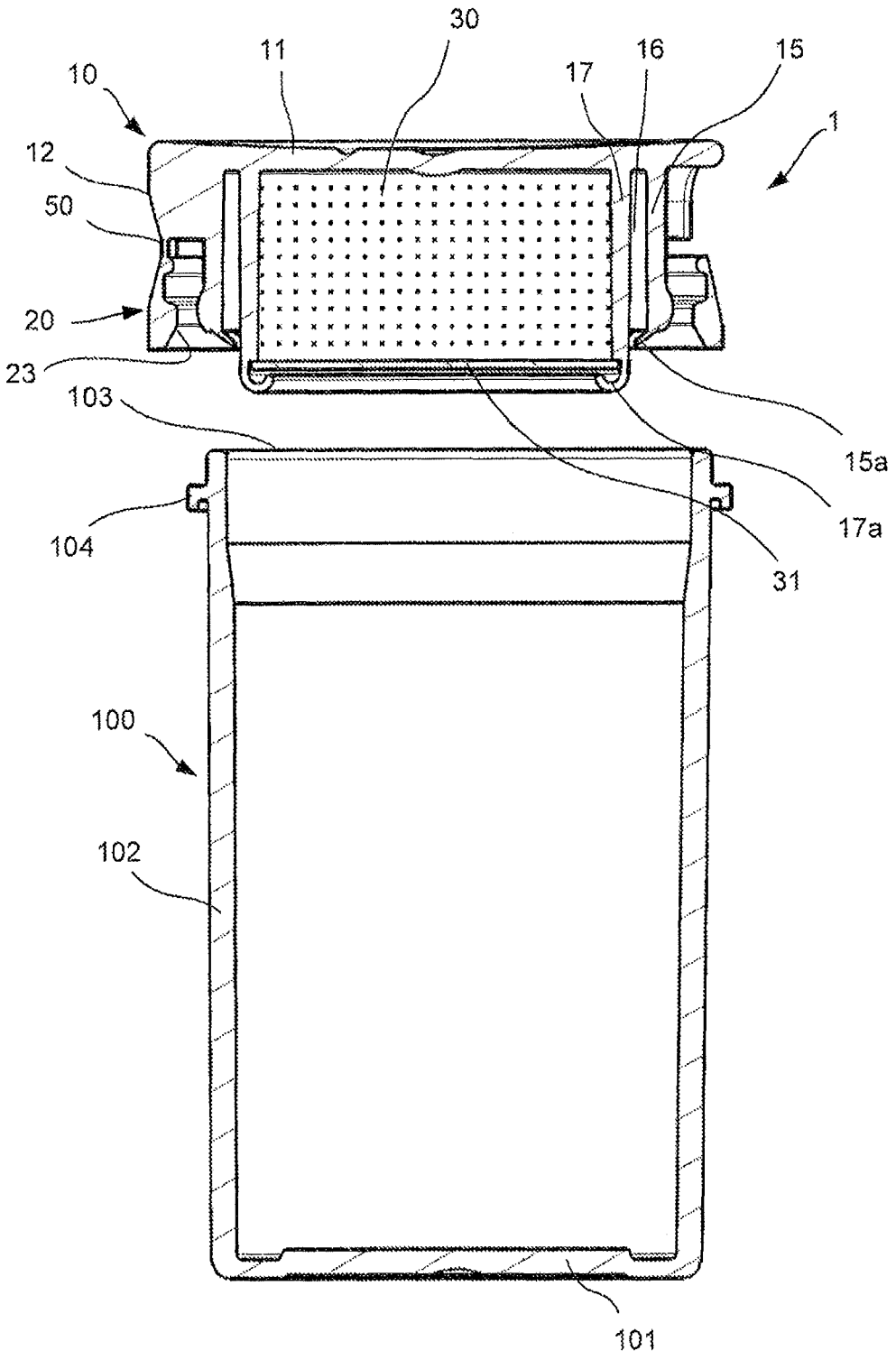
FIG. 6 is another sectional view of the cap prior to the attachment to the container.
Figure 7:
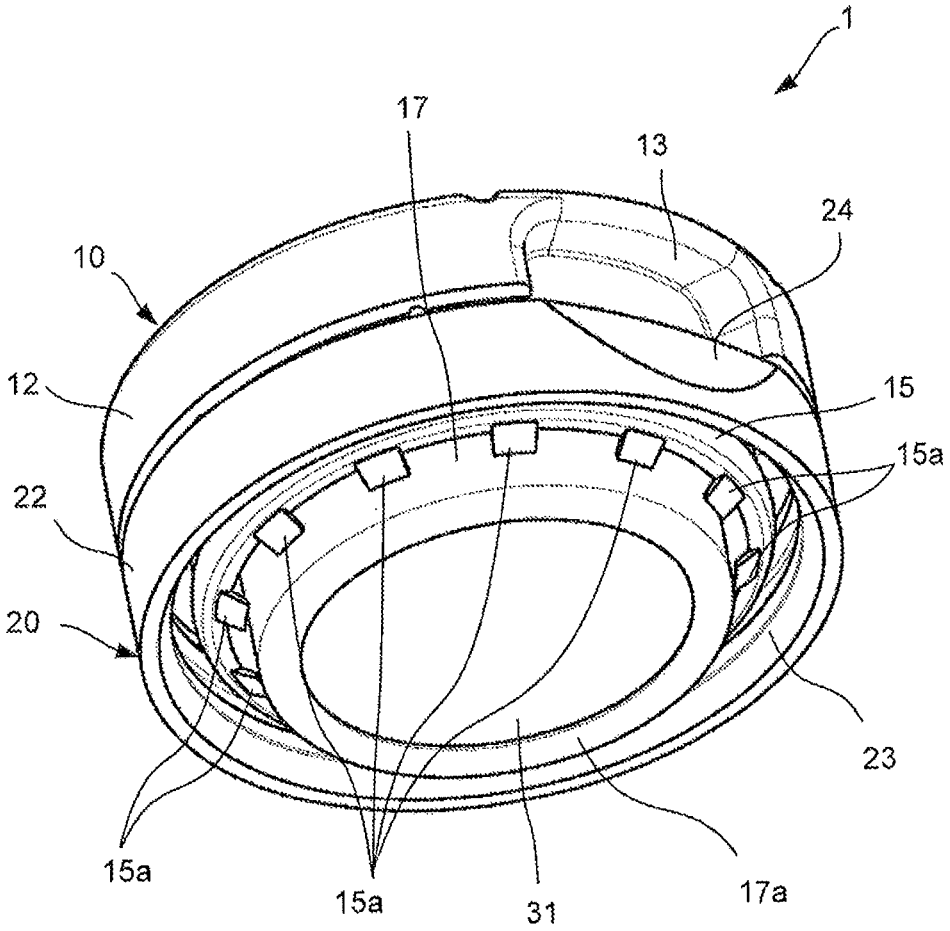
FIG. 7 is a perspective view of the cap according to the preferred embodiment of the present invention when viewed from a lower side.
Figure 8:
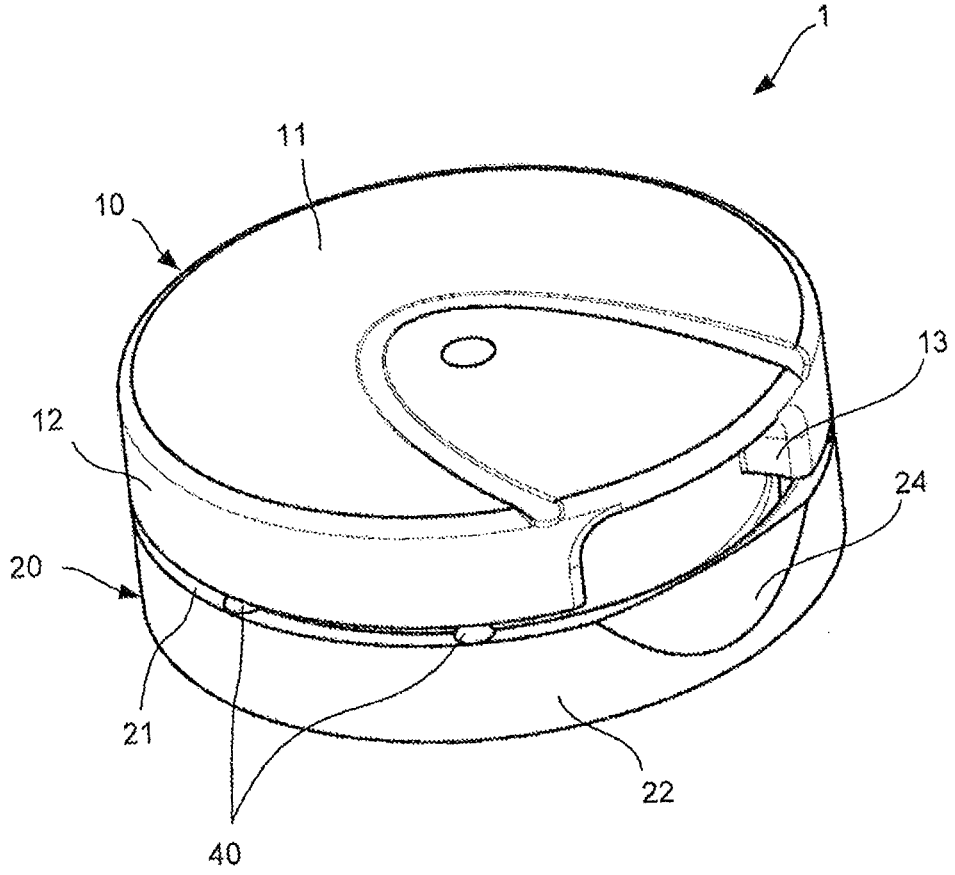
FIG. 8 is a perspective view of the cap for a container according to the preferred embodiment of the present invention when viewed from an upper side.
Figure 9:
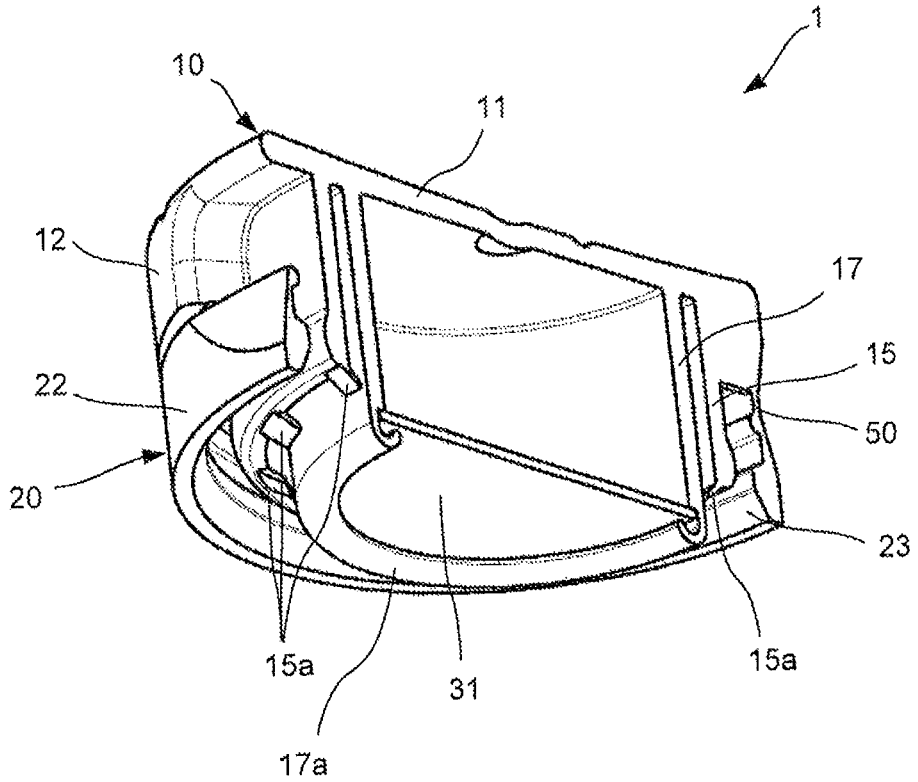
FIG. 9 is a sectional view of the cap according to the preferred embodiment of the invention when viewed from a lower side.
Figure 10:
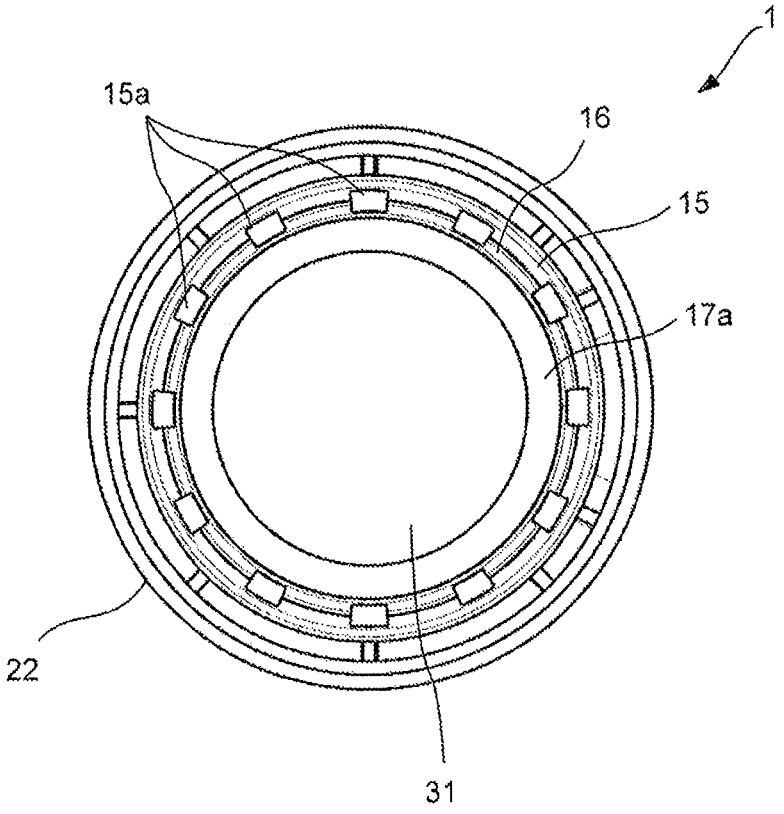
FIG. 10 is a plan view of the cap according to the preferred embodiment of the invention from a lower side.
Figure 11:
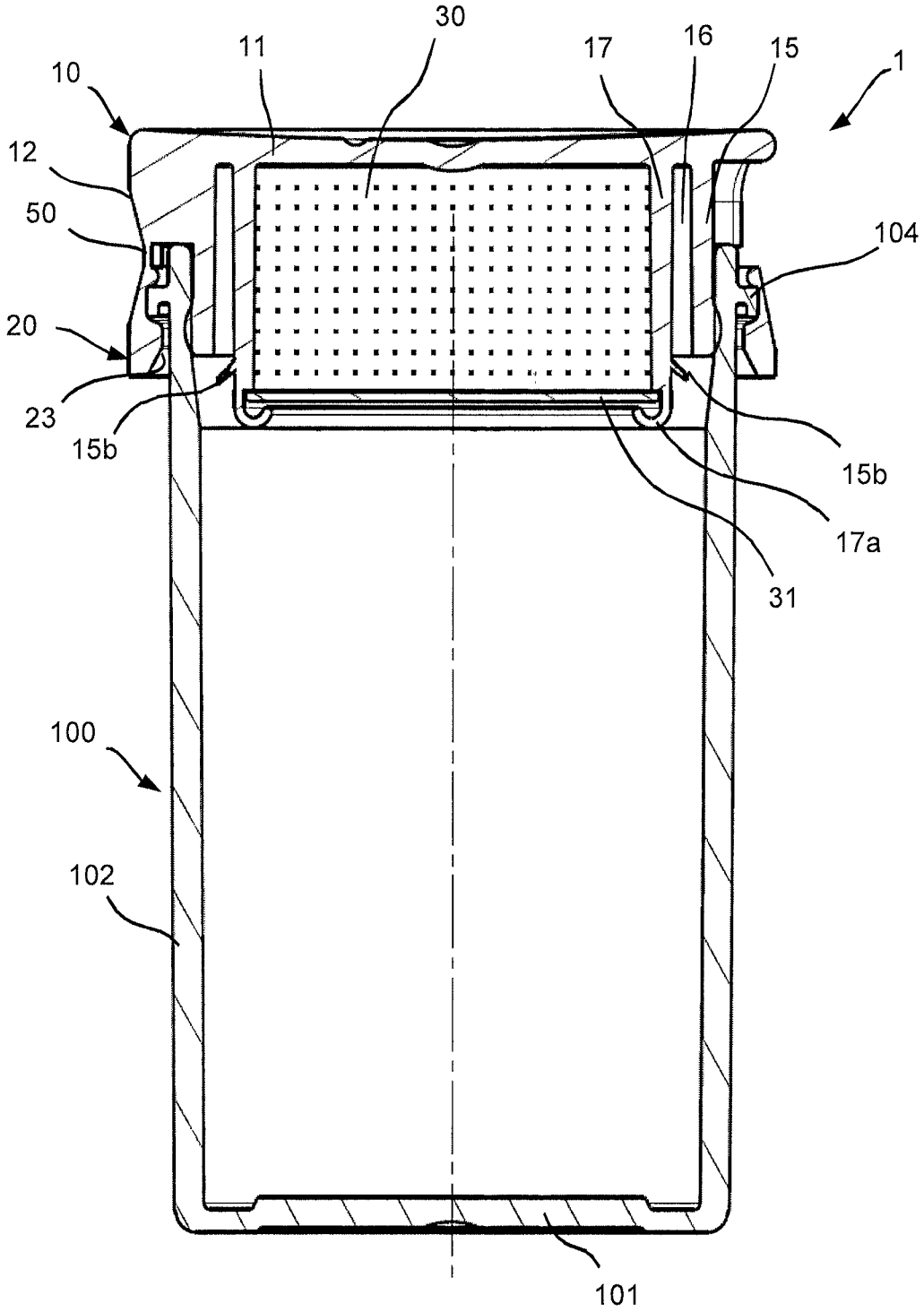
FIG. 11 is a sectional view of the cap being attached to the container wherein the projection portion extends from the inner peripheral wall for partially covering the peripheral groove.

The following explanations refer to a preferred embodiment of a cap for a container according to the present invention, which is described with reference to FIGS. 1-10. Further modifications and variations of single features mentioned in connection with the present embodiment may each be combined with each other, respectively, thereby providing additional embodiments of the present invention.

A cap 1 according to the present embodiment is attached to a tubular container 100, wherein the container 100 has a substantially cylindrical form with a closed bottom portion 101, a peripheral wall portion 102 and an opening 103 opposite to the bottom portion 101. A rib portion 104 is formed adjacent to the opening 103 on the peripheral wall portion 102. The rib portion 104 can interact with a corresponding part of the cap 1.

The cap 1 comprises a lid body 10 and a ring-element 20, which are connected to each other by a film hinge 50 and a plurality of frangible webs 40 arranged on an upper portion 21 of the ring-element 20. The frangible webs 40 are broken once the lid body 10 is opened for the first time. Accordingly, the ring-element 20 is in the present case a so-called tamper-evident ring. The ring-element 20 further comprises an outer wall 22 and an inner curved surface 23 providing a joining part for connecting the ring element 20 to the rib 104 of the container 100.

The lid body 10 includes a top part 11 (upper portion of the lid body) and an outer peripheral wall 12. The outer peripheral wall 12 comprises a grip portion 13, which is arranged opposite to a recessed portion 24 of the ring element 20. Thereby, a consumer may easily access the grip portion 13 for opening the lid body 10.

A sealing skirt 15 of the lid body 10 extends substantially from the top part 11 and may snugly fit an inner peripheral wall of the container 100, when the cap 1 attached thereto. Further, an inner peripheral wall 17 is provided on the lid body 10, which extends substantially from the top part 11, and may be aligned concentrically to the sealing skirt 15. The distal portion 17*a* of the inner peripheral wall 17 extends further from the top part 11 as compared to a distal portion of the sealing skirt 15.

The distal portion 17*a* of the inner peripheral wall 17 is deformed so as to support a permeable surface element 31, which is according to the present embodiment a cardboard 31. In particular, the distal portion 17*a* is bent towards the axis of the lid body 10, thereby fixing the cardboard 31 to a step portion provided on an inner side of the inner peripheral wall 17. Thereby, the top part 11, the inner peripheral wall 17 and the cardboard 31 form a desiccant chamber 30, wherein a desiccant element is contained. The desiccant element is defined as an agent able to trap and/or release gas or vapor, such as oxygen or moisture. Examples of such agents contained in the desiccant chamber are active carbon, silica gel, molecular sieve, clay or other zeolites. Further examples are iron-based oxygen scavengers, organic oxygen scavengers, enzymatic scavengers or unsaturated polymers, or a mixture thereof.

According to the present preferred embodiment, several projection portions 15*a* are provided on a distal end of the sealing skirt 15. The projection portions 15*a* are in the present case integrally molded with the sealing skirt 15, but may also be fixed thereto in the fabrication process.

The projection portions 15*a*, which comprise according to the present embodiment in cross-section a tapered shape, extend from the distal end of the sealing skirt 15, and are inclined towards the inner peripheral wall 17. Between the distal end of the projections portions 15*a* and the peripheral wall 17, an interstice is formed which is according to the preferred embodiment around 0.5 mm or more. Thereby, direct contact between the sealing skirt 15 and the inner peripheral wall 17 is avoided under normal conditions, so that the flexibility of the sealing skirt 15 is assured.

According to the present embodiment, twelve projection portions 15*a* are provided, which are equally spaced from each other in the circumferential direction. However, according to a further modification, the distances between the projection portions 15*a* may vary. Further, the number of projection portions is not limited to the one specifically mentioned in connection with the present embodiment. In principle, a single projection portion may be provided for partially covering the peripheral groove 16.

Although it is preferred to arrange the projection portions 15*a* at a distal end of the sealing skirt 15, the projection portion may be placed at any vertical position of the sealing skirt 15 or on the inner peripheral wall 17. In any case, it is preferred that the projection portions 15*a* extend from the sealing skirt 15 or the inner peripheral wall 17 without increasing the thickness thereof.

The thickness of the projection portion 15*a* or 15*b* is preferably smaller than 1.5 mm, most preferably smaller than 1 mm. In particular, the thickness of the projection portion 15*a* is 0.5-1.5 mm, preferably 0.8-1 mm.

The width of the projection portion 15*a* or 15*b* is preferably around 1-5 mm, and may depend on the number of the projection portions 15*a* implemented in the cap 1.

The length of the projection portions 15*a* or 15*b* depends on the angle of inclination of the projection portions 15*a* or 15*b* and the distance between the inner peripheral wall 17 and the sealing skirt 15. The distance between the sealing skirt 15 and the inner peripheral wall 17 is preferably 1.5 mm. In a preferred embodiment, the interstice remaining between the distal end of the projection portions 15*a* or 15*b* and the opposite wall (either the inner peripheral wall 17 or the sealing skirt 15) is 0.5 mm or less than the thickness of the consumer product. The distance between two projection portions 15*a* is preferable around 1 mm to less than the width of the product accommodated in the container 100.

According to the present embodiment, the cap 1 comprises the lid body 10 and the ring-element 20. However, according to a further configuration, the cap 1 may also comprise the lid body 10 without the ring-element 20.

The invention claimed is:

1. A cap for a container, comprising:

a lid body with a top part and a peripheral wall, wherein the lid body comprises a sealing skirt and an inner peripheral wall, which extend from the top part and form a peripheral groove in between, wherein at least two separate projection portions partially cover the peripheral groove and are integrally formed with the sealing skirt, wherein each projection portion extends from the sealing skirt toward the inner peripheral wall, at an angle of inclination with respect to an extension direction of the sealing skirt, with an interstice being formed between a distal end of the projection portion and the inner peripheral wall so that the projection portion can be released when the cap is removed from a mold, and wherein the cap comprises one integral piece.

2. Cap according to claim 1, wherein the at least two separate projection portions are arranged on a distal end portion of the sealing skirt.

3. Cap according to claim 1, wherein the at least two separate projection portions are arranged on a side surface of the sealing skirt.

4. Cap according to claim 1, wherein the at least two separate projection portions are inclined with respect to an extension direction of at least one of the sealing skirt and inner peripheral wall.

5. Cap according to claim 1, wherein the cap further comprises a ring-element configured to be connected to a container, wherein the lid body is connected to the ring-element by a hinge.

6. Cap according to claim 5, wherein the ring-element comprises a tamper-evident ring comprising frangible webs, which are connected to the lid body.

7. Cap according to claim 1, wherein the cap is manufactured by injection molding of polymer material, wherein the polymer material is selected from the group consisting of PEHD, PEBD and PP.

8. Cap according to claim 1, wherein the width of each projection portion is 1-5 mm.

9. Cap according to claim 1, wherein the at least two projection portions are located equidistant to each other in a circumferential direction.

10. Cap according to claim 1, wherein the inner peripheral wall is provided with a permeable surface so as to form a chamber, wherein the permeable surface is selected from the group consisting of a permeable polymer, a cardboard and a paper sheet.

11. Cap according to claim 10, wherein the chamber contains an active agent selected from the group consisting of active carbon, silica gel, molecular sieve, clay, other zeolites, and mixtures thereof.

12. Cap according to claim 1, wherein each projection portion tapers towards its distal end.

13. Container comprising the cap according to claim 1 attached thereto.

14. Cap according to claim 4, wherein each projection portion is inclined with respect to the extension direction of the sealing skirt or inner peripheral wall by 30-60 degrees.

15. Cap according to claim 1, comprising from 8-14 projection portions.

16. Cap according to claim 5, wherein the hinge comprises a film-hinge.

17. A cap for a container, comprising:

a lid body with a top part and a peripheral wall, wherein the lid body comprises a sealing skirt and an inner peripheral wall, which extend from the top part and form a peripheral groove in between, wherein at least two separate projection portions partially cover the peripheral groove and are integrally formed with the inner peripheral wall, wherein each projection portion extends from the inner peripheral wall toward the sealing skirt, at an angle of inclination with respect to an extension direction of the inner peripheral wall, with an interstice being formed between a distal end of the projection portion and the sealing skirt so that the projection portion can be released with the cap is removed from a mold, and wherein the cap comprises one integral piece.

18. Cap according to claim 17, wherein the cap further comprises a ring-element configured to be connected to a container, wherein the lid body is connected to the ring-element by a hinge.

19. Cap according to claim 17, wherein each projection portion tapers towards its distal end.

20. Container comprising the cap according to claim 17 attached thereto.

21. Cap according to claim 17, wherein each projection portion is inclined with respect to the extension direction of the sealing skirt or inner peripheral wall by 30-60 degrees.

22. The cap of claim 1 wherein the at least two separate projection portions are wedge-shaped and exhibit flexibility.

* * * * *